US005495862A

United States Patent [19]

Dewing

[11] Patent Number: 5,495,862

[45] Date of Patent: Mar. 5, 1996

[54] BARRETTE

[76] Inventor: Andrew Dewing, P.O. Box 82-144, Taipei City, Taiwan

[21] Appl. No.: 290,135

[22] Filed: Aug. 15, 1994

[51] Int. Cl.[6] ..... A45D 8/22

[52] U.S. Cl. ..... 132/279; 132/278

[58] Field of Search ..... 132/279, 278; D28/39, 40, 41, 42

[56] References Cited

U.S. PATENT DOCUMENTS

| | | | |
|---|---|---|---|
| 3,805,813 | 4/1974 | Laughton | 132/279 |
| 4,919,155 | 4/1990 | Yasuda | 132/279 |
| 5,379,783 | 1/1995 | Healzer et al. | 132/279 |

FOREIGN PATENT DOCUMENTS

| | | | |
|---|---|---|---|
| 2224103 | 10/1974 | France | 132/279 |
| 2581298 | 11/1986 | France | 132/279 |

*Primary Examiner*—John G. Weiss
*Attorney, Agent, or Firm*—Alfred Lei

[57] ABSTRACT

A barrette including an ornamental cover having a recess at a central portion, a first bracket fixedly mounted on an end of the ornamental cover and including a pair of ledges extending upwardly from a bottom thereof, a curved platform extending upwardly from the bottom and having a pair of lugs and a stop portion between the lugs, and a pair of hooks extending upwardly from the bottom and located between the ledges and the curved platform, a second bracket fixedly mounted on another end of the ornamental cover and having a pair of arms and a spring board curving upwardly, a release member pivotally connected with the lugs of the platform of the first bracket and having a longitudinal tongue extending toward the stop portion of the curved platform, and a locking member provided with an engaging portion at one end and a journal portion at another end.

3 Claims, 5 Drawing Sheets

BARRETTE

BACKGROUND OF THE INVENTION

It has been found that the hair clip known in the art includes a strip 110 fixed to an ornamental cover 100, a spring board 120 fixed to the strip 110 at both ends, and a retainer 130 having an end pivotally connected with the strip 110 and another end releasably fixed to the strip 110.

However, it is impossible to form a central recess in the ornamental cover 100 without exposing the strip 11.

Therefore, it is an object of the present invention to provide a barrette which can obviate and mitigate the above-mentioned drawbacks.

SUMMARY OF THE INVENTION

This invention relates to a barrette.

It is the primary object of the present invention to provide a barrette which has an ornamental cover with a central recess.

It is another object of the present invention to provide a barrette which can prevent the hair from entangling therewith.

It is still another object of the present invention to provide a barrette which is easy to use.

It is still another object of the present invention to provide a barrette which is simple in construction.

It is a further object of the present invention to provide a barrette which is facile to manufacture.

The other objects and merits and a fuller understanding of the present invention will be obtained by those having ordinary skill in the art when the following detailed description is read in conjunction with the accompanying drawings wherein like numerals refer to like or similar part.

DETAILED DESCRIPTION OF THE PREFERRED EMBODIMENT

Figure 1:
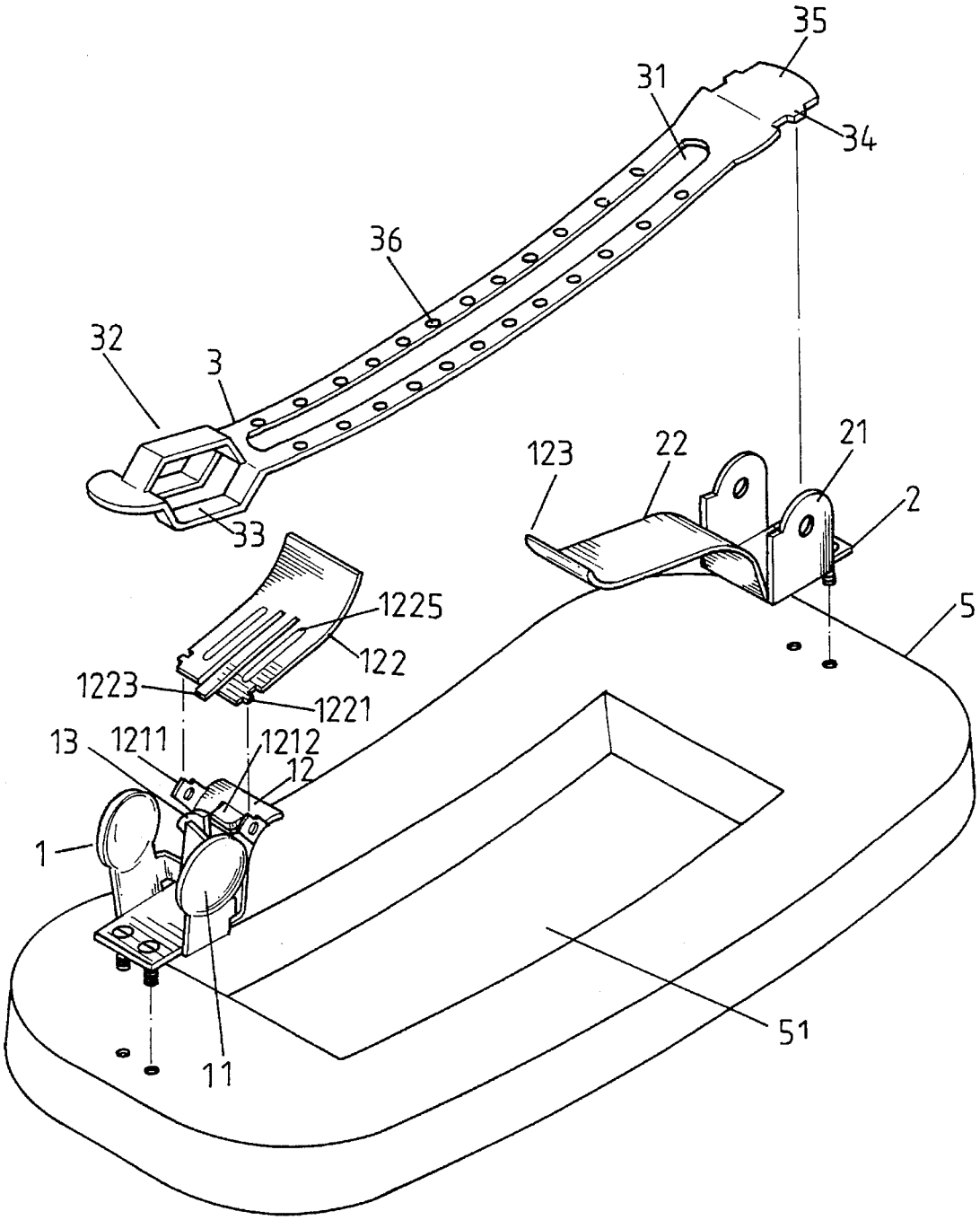
FIG. 1 is an exploded view of the present invention.

For the purpose of promoting an understanding of the principles of the invention, reference will now be made to embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
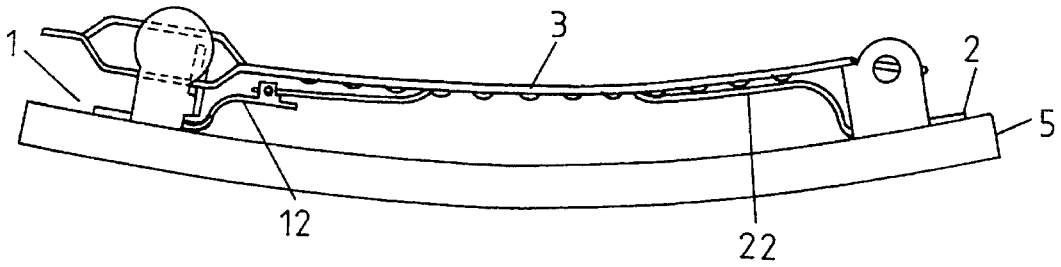
FIG. 2 is a side view of the present invention, shown in the closed condition.
Figure 3:
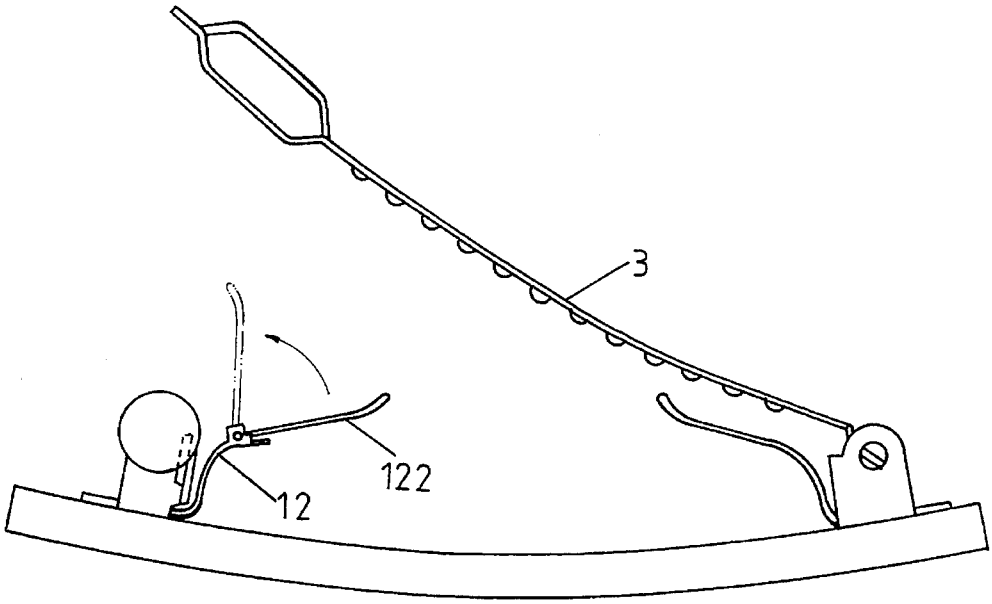
FIG. 3 is a side view of the present invention, shown in the open condition.
Figure 6:
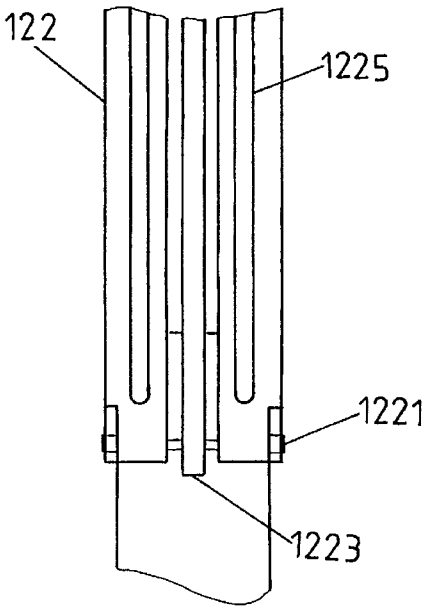
FIG. 6 is an enlarged top plan view of the movable member.
Figure 5:
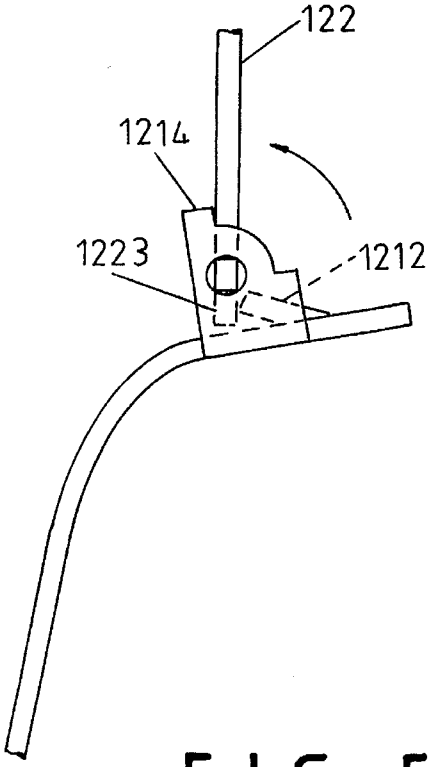
FIG. 5 shows how the release member works.
Figure 4:
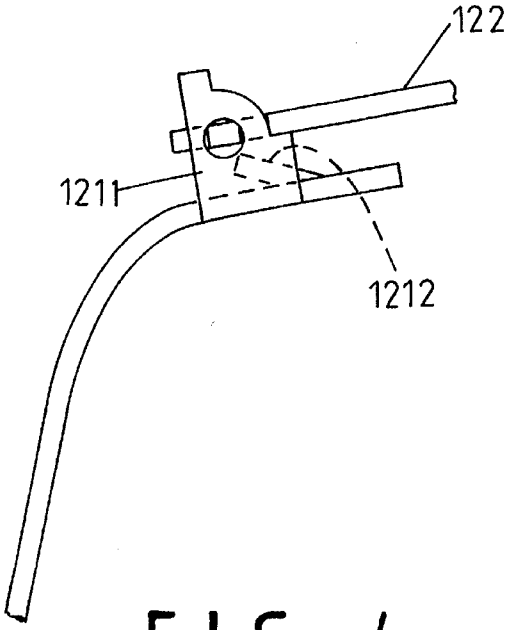
FIG. 4 is an enlarged side view of the movable member.

With reference to the drawings and in particular to FIGS. 1, 2 and 3 thereof, the barrette according to the present invention mainly comprises an ornamental cover 5, a first bracket 1 fixedly mounted on an end of the ornamental cover 5 by screws, a second bracket 2 fixedly mounted on another end of the ornamental cover 5 by screws (shown but not numbered), a release member 122 pivotally connected with the first bracket 1, and a locking member 3. The ornamental cover 5 is made of some suitable ornamental material and has a recess 51 at the central portion. The first bracket 1 includes a pair of ledges 11 extending upwardly from the bottom thereof, a curved platform 12 extending upwardly from the bottom and having a pair of lugs 1211 and a stop portion 1212 between the lugs 1211, and a pair of hooks 13 extending upwardly from the bottom and located between the ledges 11 and the curved platform 12. A release member 122 is provided with a pair of pivot portions 1221 engaged with the lugs 1211 of the curved platform 12 of the first bracket 1 and is snugly fitted with the lugs 1211. Further, the release member 122 has a longitudinal tongue 1223 at the central portion which extends toward the stop portion 1212 of the curved platform 12 and will bear against the stop portion 1212 of the platform 12 when rotated to a vertical position (see FIGS. 4 and 5). Further, the release member 122 has two longitudinal ribs 1225 each provided at one side of the tongue 1223 (see FIG. 6). The second bracket 2 is provided with a pair of arms 21 and a spring board 22 having an outer edge 123 curving upward. The locking member 3 is made of spring steel and provided with an elongated slot 31. In addition, the locking member 3 is provided with an engaging portion 32 at one end and a journal portion 35 at the other end. The engaging portion 32 includes two arched bridges 33 and a dented part interposed therebetween for engaging the hooks 13 of the first bracket 1, and the journal portion 35 includes a pair of pivot portions 34 engaged with the arms 21 of the second bracket 2. Besides, the locking member 3 has a plurality of protuberances 36 for increasing friction between the hair and the barrette.

Figure 7:
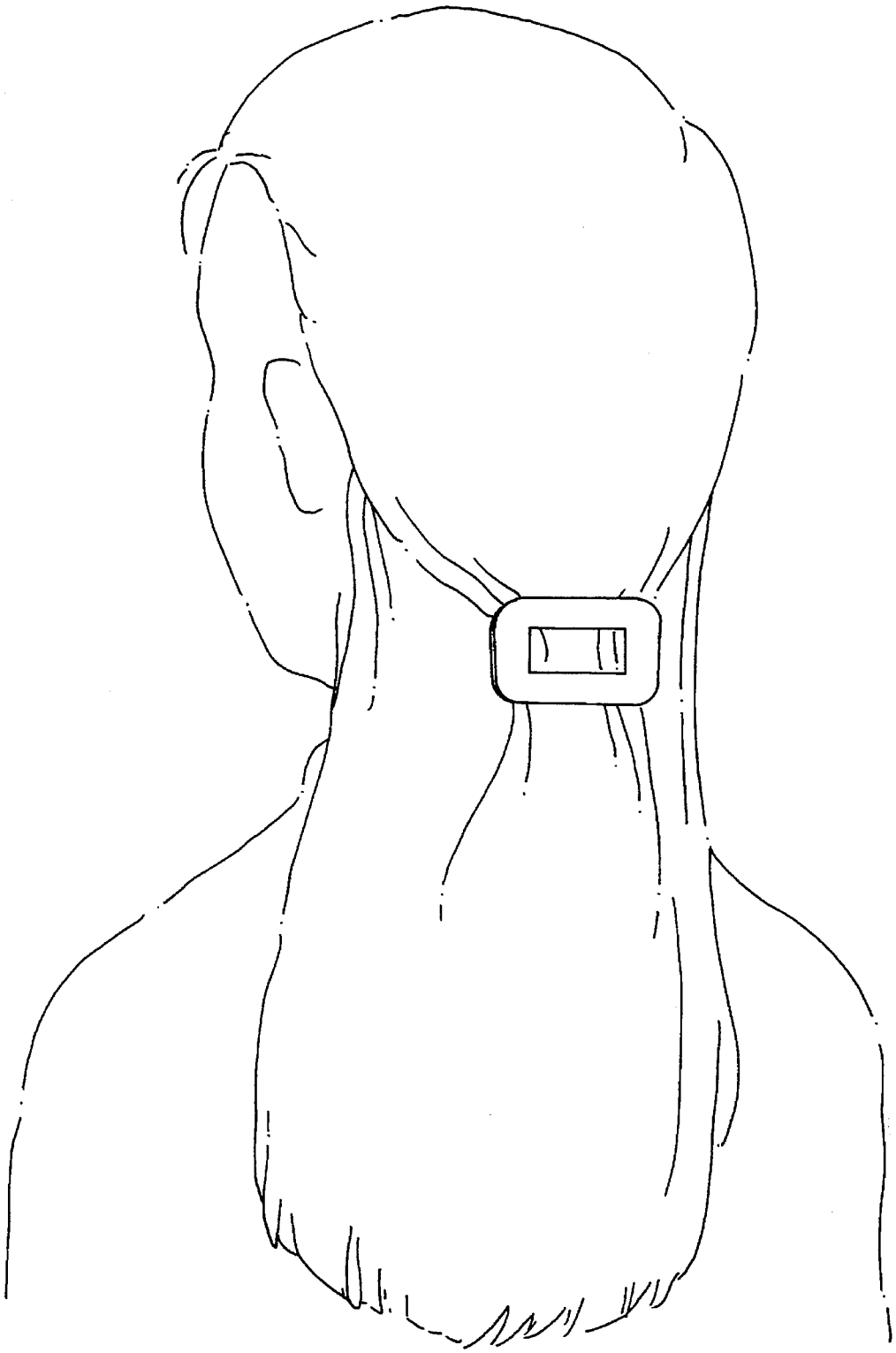
FIG. 7 is a working view of the present invention.
Figure 8:
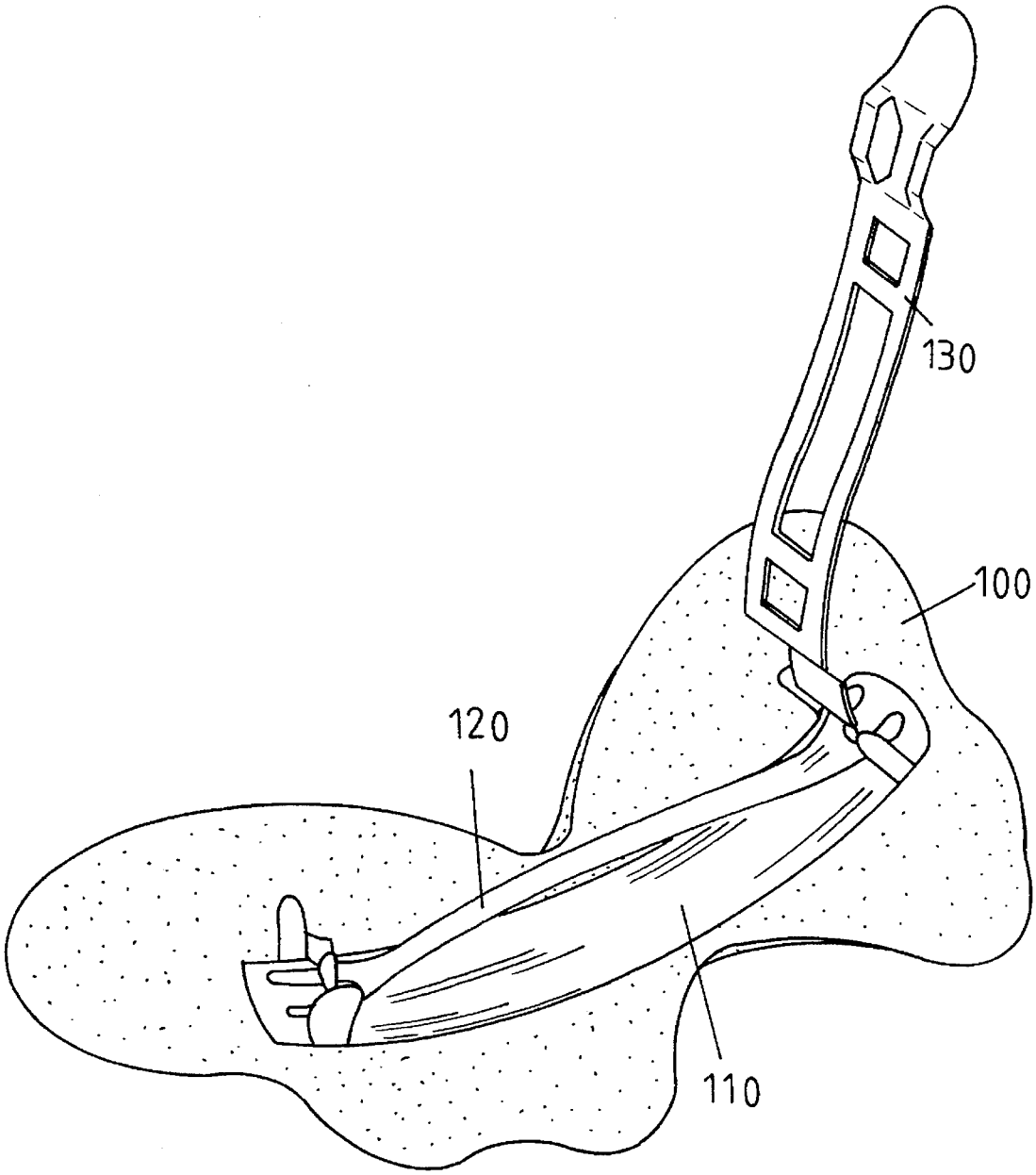
PRIOR ART FIG. 8
FIG. 8 is a perspective view of the present invention.

When in use, the hair (see FIG. 7) is disposed between the first and second brackets 1 and 2 thereby preventing the locking member 3 and the brackets i and 2 from being seen from outside.

When desired to open the barrette, simply press the ledges 11 toward each other by fingers, so that the hook 13 overlap excessively to come through the arched bridges 33 of the locking member 3. Then, the locking member 3 automatically opens under the repulsion of the release member 122.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A barrette comprising:

an ornamental cover having a recess at a central portion;

a first bracket fixedly mounted on an end of said ornamental cover and including a pair of ledges extending upwardly from a bottom thereof, a curved platform extending upwardly from the bottom and having a pair of lugs and a stop portion between said lugs, and a pair of hooks extending upwardly from the bottom and located between said ledges and said curved platform;

a second bracket fixedly mounted on another end of said ornamental cover and having a pair of arms extending upwardly from a base of the second bracket and a spring board curving upwardly from said base;

a release member pivotally connected with the lugs of the platform of said first bracket and having a longitudinal tongue extending toward the stop portion of said curved platform; and a locking member provided with an engaging portion at one end and a journal portion at another end, said engaging portion including two arched bridges and a dented part interposed therebetween for engaging the hooks of said first bracket and the journal portion including a pair of pivot portions engaged with the arms of said second bracket.

2. The barrette as claimed in claim 1, wherein said locking member is formed with an elongated slot.

3. The barrette as claimed in claim 1, wherein said locking member is provided with a plurality of protuberances.

* * * * *